US007674522B2

(12) United States Patent
Pohlmann

(10) Patent No.: US 7,674,522 B2
(45) Date of Patent: Mar. 9, 2010

(54) WOOD FIBER INSULATING MATERIAL BOARD OR MAT

(75) Inventor: Cevin Marc Pohlmann, Hoisdorf (DE)

(73) Assignee: Kronotec AG, Lucerne (CH)

( * ) Notice: Subject to any disclaimer, the term of this patent is extended or adjusted under 35 U.S.C. 154(b) by 320 days.

(21) Appl. No.: 11/314,705

(22) Filed: Dec. 21, 2005

(65) Prior Publication Data

US 2006/0148364 A1 Jul. 6, 2006

(30) Foreign Application Priority Data

Dec. 21, 2004 (DE) ..... 10 2004 062 647.2

(51) Int. Cl.
*B32B 5/66* (2006.01)

(52) U.S. Cl. ..... 428/323; 428/326; 428/327; 428/292.4; 428/296.7; 428/298.1; 428/340; 428/359; 428/360; 428/403; 442/334; 442/416; 442/417; 181/290; 181/294; 19/145.5; 19/296

(58) Field of Classification Search ..... 19/1, 19/145.5, 296; 52/22, 407.3, 309.11, 406.2, 52/793.1; 106/282, 644, 162.51, 164.5, 164.53, 106/164.6, 204.01, 216.1, 217.01, 696, 711, 106/716, 790, 797, DIG. 2, DIG. 3; 156/42, 156/276, 292, 337, 41, 44, 45, 62.2, 62.4; 160/40, 84.01; 162/109, 113, 125, 141, 142, 162/143, 145, 146, 147, 149, 157.1, 171, 162/175, 181.1, 205; 181/290, 294; 210/500.1; 242/62; 264/289.3, 122, 123, 146, 258, 288.8, 264/290.5, 45.3, 46.2, 46.3, 50, 53, DIG. 5; 425/115, 817 C; 428/158, 292.1, 297.1, 428/309.9, 313.7, 314.4, 317.9, 319.1, 331, 428/339, 359, 360, 403, 404, 405, 407, 489, 428/74, 76, 903, 920, 117, 139, 220, 308.4, 428/338, 113, 213, 323, 326, 327, 292.4, 428/296.7, 298.1, 340; 442/153, 334, 413, 442/210, 266, 338, 352, 409, 412, 418, 416, 442/417, 35

See application file for complete search history.

(56) References Cited

U.S. PATENT DOCUMENTS

| | | | | | |
|---|---|---|---|---|---|
| 3,623,938 | A | * | 11/1971 | Jenkins | 428/338 |
| 3,628,626 | A | * | 12/1971 | Merrill | 181/290 |
| T967,003 | I4 | * | 2/1978 | Witt et al. | 428/113 |
| 4,313,997 | A | * | 2/1982 | Ruff et al. | 428/220 |
| 4,572,857 | A | * | 2/1986 | Bekaert | 428/117 |
| 5,272,000 | A | * | 12/1993 | Chenoweth et al. | 442/35 |
| 5,418,031 | A | * | 5/1995 | English | 428/74 |
| 5,516,580 | A | * | 5/1996 | Frenette et al. | 442/153 |
| 5,714,107 | A | * | 2/1998 | Levy et al. | 264/289.3 |
| 5,749,954 | A | * | 5/1998 | Law et al. | 106/282 |
| 5,886,306 | A | * | 3/1999 | Patel et al. | 181/290 |
| 5,983,586 | A | * | 11/1999 | Berdan et al. | 52/407.3 |
| 6,093,473 | A | * | 7/2000 | Min | 428/147 |
| 6,133,170 | A | * | 10/2000 | Suenaga et al. | 442/334 |
| 7,041,196 | B2 | * | 5/2006 | Lorenz et al. | 162/109 |

FOREIGN PATENT DOCUMENTS

| | | | | |
|---|---|---|---|---|
| BE | 904013 | A | * | 7/1986 |
| DE | 100 56 829 | A1 | | 6/2002 |
| DE | 10056829 | A1 | * | 6/2002 |
| DE | 10 2004 011 931 | A1 | | 9/2005 |
| FR | 2827365 | | * | 7/2001 |
| JP | 52065519 | | * | 5/1977 |
| WO | WO 9927206 A 1 | | * | 6/1999 |

* cited by examiner

*Primary Examiner*—Leszek Kiliman
(74) *Attorney, Agent, or Firm*—Laurence A. Greenberg; Werner H. Stemer; Ralph E. Locher

(57) ABSTRACT

The invention relates to wood fiber insulating material boards and mats, in which the wood fibers and the binder fibers are aligned three-dimensionally. The fleece of wood fibers and binder fibers can alternatively have synthetic resin granules scattered on it. Likewise, a woven fabric or a film can be applied to one or both sides. The product obtained in this way is heated in a heating/cooling oven, calibrated and/or compacted to the desired final thickness.

30 Claims, No Drawings

WOOD FIBER INSULATING MATERIAL BOARD OR MAT

BACKGROUND OF THE INVENTION

Field of the Invention

The invention relates to wood fiber insulating material boards or mats having improved properties.

Processes for the production of wood fiber insulating material boards and mats are known. For example, wood fiber insulating material boards and mats are produced in the wet process. The boards and mats produced by this process are relatively thin and the expenditure during production is high; in particular high costs arise for the drying.

It is also known to produce mats by using wood fibers or other fibrous natural products in conjunction with plastic fibers. These mats are fabricated on carding machines known from the textile industry. These boards also have only a low thickness. If thicker boards are desired, then a plurality of the boards originally obtained are laid above one another in layers.

Furthermore, DE 100 56 829 discloses a process for the production of insulating material boards and mats from wood fibers and plastic fibers, in which the boards have a thickness of about 20 mm and are fabricated in one operation. In this case, the wood fibers and plastic fibers are mixed together in the desired ratio, scattered loosely in a single layer on an endless wire belt, compressed and calibrated by a second wire belt arranged above the first wire belt and subsequently consolidated in a heating unit arranged downstream.

The wood fiber insulating material boards obtained are distinguished by a layer structure, since the fibers lie on one another aligned more or less in one direction as they are scattered onto the wire belt, as is generally known from the production process of MDF boards.

Such boards, which are used for insulation and for panel board production, have a low transverse tensile strength. The individual layers can be separated from one another without trouble in insulating boards.

In order to increase the transverse tensile strength, it is further known in board production to scatter the raw materials in a plurality of layers, the scattering direction being rotated through 90° in each case. The product obtained is then pressed. In this case, the known OSB (oriented strand board) is obtained. This product can also be obtained by the conventional procedure being applied. In this case, the mass obtained on the transport belt is pressed slightly, the product obtained is cut up into matched pieces in a further process, these are placed above one another in each case offset by 90° and finally pressed. The product obtained in this way exhibits an improved transverse tensile strength but the production is time-consuming and needs a great deal of expenditure on plant.

SUMMARY OF THE INVENTION

The invention is based on the object of producing single-layer wood fiber insulating material boards and mats with a wide thickness range with good transverse tensile strength and compressive rigidity and a wide density range.

The wood fiber insulating material boards and mats according to the invention exhibit a three-dimensional alignment of the wood fibers and of the binder fibers and have layer thicknesses from 3 to 350 mm with bulk densities from 20 to 300 kg/m$^3$. For the production of the wood fiber insulating material boards and mats according to the invention, use is preferably made of apparatus as is known for the production of fleeces by the nonwoven process and has been developed by the DOA company in A-4600 Wels.

In order to produce the wood fiber insulating material boards and mats according to the invention, the wood fibers are used with a moisture between 7 and 16%, in particular 12 and 14%.

If use is made of wood fibers which are obtained from pulped wood in a refiner, then these are previously mixed in a known manner with flame prevention and/or hydrophobicizing agents in quantities of 8 to 30%, in particular 10 to 20%, and dried to the desired dryness, dust and fibers with short lengths or diameters being removed at the same time.

The addition of the flame prevention and/or hydrophobicizing agents and the drying of the wood fibers are normally carried out separately from the production according to the invention of the wood fiber insulating material boards and mats.

In addition to the wood fibers, further natural fibers, such as hemp, flax, sisal, can additionally be used to some extent instead of the wood fibers, in order to achieve specific desired properties in the wood fiber insulating material boards and mats according to the invention.

In accordance with the desired composition, the individual components are weighed out by separate weighing devices and are put into the storage container via a blow line.

For the production of the wood fiber insulating material boards and mats according to the invention, the wood fibers are used in mixing ratios to binder fibers of 95 to 80 to 5 to 20% and preferably of 90 to 10%. In these material mixtures, up to 30% of the wood fibers can be replaced by other natural fibers.

The quantity of fiber mixture supplied onto a first transport belt depends on the layer thickness and bulk density of the wood fiber insulating material board or mat to be produced, it being possible for the bulk densities to lie between 20 and 300 kg/m$^3$ In the preliminary fleece obtained, the alignment of the fibers is three-dimensional.

In order to improve the compressive strength, thermally activatable plastic granules can optionally be scattered onto the preliminary fleece. Well-suited to this purpose are plastic granules such as those which occur during the recycling of plastic articles from the Dual System. It is also possible to use granules which consist of a thermally resistant core and an encapsulation of plastic resins, which soften at the temperatures used in the heating zone. The plastic granules can be added in quantities of 5 to 45%, primarily in quantities of 10 to 40% and in particular in quantities of 22 to 37%, based on the fiber mixture respectively used. A powder scatterer ensures a uniform distribution of the plastic granules scattered on over the entire width of the fiber fleece moved on the first transport belt. The preliminary fleece is defibered at the end of the first transport belt. The mixture obtained is applied to a second transport belt in the desired layer thickness with a three-dimensional alignment of the fibers. The layer thickness of the mat can be between 3 and 400 mm.

If desired, woven fabrics or nonwovens of organic, inorganic or natural fibers can be laid on one or both sides of the endless mat obtained in this way. Likewise conceivable are webs of cellulose or films. The woven fabric, nonwovens or webs applied can be structured and/or perforated. Likewise, coloration is possible. Therefore, the desired properties of the wood fiber insulating material boards and mats according to the invention can be improved further.

The mats obtained in this way are transferred to an endless oven belt and led through the heating/cooling oven. In the process, the temperatures prevailing in the heating oven soften and therefore activate the binder fibers and also the plastic granules. The temperatures in the heating oven are 130 to 200° C. and in particular 160 to 185° C. Both the binder fibers and the plastic granules ensure an intimate connection to the wood fibers and to the woven fabric webs or films possibly laid on.

In the heating oven, a calibration zone follows the heating zone, in which the mats are made uniform in terms of their thickness and, if desired, are compressed to the final thickness of the wood fiber insulating material boards or mats according to the invention. In this way, the mats obtained are compacted to thicknesses from 3 to 350 mm, in particular 4 to 250 mm.

Following the calibration, the mats obtained are supplied with the oven belt to a cooling zone, and the final processing to form the desired wood fiber insulating material boards or mats according to the invention is carried out. The mat is hemmed at the edges and then divided longitudinally and/or transversely.

Wood fiber insulating material boards and mats are produced which are characterized by a wide range of board thickness from 3 to 350 mm, in particular 4 to 250 mm, with bulk densities from 20 to 300 kg/m$^3$ and, in addition to an improved transverse tensile strength, also exhibit an increased compressive rigidity.

The wood fiber insulating boards and mats according to the invention can be used as acoustic insulating boards, as footfall insulating mats for laminate or parquet floors, as insulating board secure against passage, as a thermal insulating composite board, as inter-rafter insulation and the like. By means of webs of nonwovens, woven fabrics and the like, made of inorganic, organic or natural fibers or films, which can be structured, perforated, colored, additionally applied to one or both sides, the range of uses of the wood fiber insulating material boards and mats according to the invention is increased further.

DESCRIPTION OF THE PREFERRED EMBODIMENTS

The invention is to be explained in more detail below by using examples.

Example 1

For the production of a wood fiber insulating material board, 10 parts of binder fibers are mixed with 90 parts of wood fibers, which have previously been provided with flame prevention agents, and, via a storage container, are blown uniformly onto a first transport belt after being weighed, so that the bulk density is 30 to 60 kg/m$^3$, in particular 35 to 45 kg/m$^3$. At the end of the first transport belt, the preliminary fleece is defibered and, after loosening, is blown onto a second transport belt with a thickness between 60 and 250 mm, and the endless mat obtained in this way is transferred onto the oven belt. After the heating zone, the mat is brought into the cooling zone without great compaction but only evening out and, after that, is divided to the desired dimensions.

Example 2

For the production of a wood fiber insulating material board as an acoustic board, as described in example 1, the material is blown onto the second transport belt and, after building up the desired layer thickness, is covered on one side with a perforated fiber nonwoven in strip form. In the heating oven, the binder fibers ensure the connection of the wood fibers and attachment of the nonwoven layer to the wood fiber insulating material board formed.

Example 3

For the production of absorbers or resonators, 88 parts of wood fibers are mixed with 12 parts of binder fibers and blown out of the storage container onto a first transport belt in quantities such that a bulk density of 35 to 100 kg/m$^3$ is achieved in the mat. Following comminution of the preliminary fleece obtained at the end of the transport belt 1, the material is blown onto a second transport belt in thicknesses between 30 and 120 mm. The mat obtained is treated further as described in example 1.

Example 4

For the production of wood fiber insulating materials for use in acoustics, 10 parts of binder fibers are mixed with 75 parts of wood fibers and 15 parts of flax fibers and, via a storage container, are blown uniformly onto a first transport belt, in order that an end product having a bulk density of 35 to 130 kg/m$^3$ is obtained. With comminution of the preliminary fleece at the end of the first transport belt and thorough mixing once more, the material of the preliminary fleece is blown onto the second transport belt to give a layer thickness of 4 to 200 mm. The endless mat obtained is treated further as described in example 1.

Example 5

For the production of a wood fiber/hemp fiber insulating material board, 12 parts of binder fibers, 60 parts of wood fibers and 28 parts of hemp fibers are mixed together. The material is blown uniformly out of the storage container onto a first transport belt in such quantities that bulk densities of 25 to 50 kg/m$^3$, in particular 25 to 40 kg/m$^3$, are obtained. With the mixing of the components of the preliminary fleece from the first transport belt once more, the mass is blown uniformly onto a second transport belt. In this case, the speed of the second transport belt is adjusted such that mat thicknesses of 80 to 250 mm are obtained. The further processing is carried out in the manner described in example 1.

All the wood fiber insulating material boards and mats obtained in the abovementioned examples exhibit a higher transverse tensile strength than the previously known wood fiber insulating material boards and mats used for the same purposes.

Example 6

For the production of wood fiber insulating material mats as footfall mats in laminate or parquet floors, 11 parts of binder fibers are mixed with 89 parts of wood fibers and supplied to the storage container. From the latter, the fiber mixture is blown onto a first transport belt to form a uniform fleece which has a bulk density of 150 to 280 kg/m$^3$, in particular 150 to 180 kg/m$^3$. Before the fibers are mixed once more at the end of the first transport belt, by means of a powder scatterer arranged over the entire width of the first transport belt, plastic granules, such as accumulate during the recycling of synthetic resin products from the Dual System, are applied in quantities such that, in the fleece obtained on the second transport belt, a quantity ratio of wood fibers to binder fibers to synthetic resin granules of 55:7:38 is provided. The mat thickness on the second transport belt is 5 to 10 nm. The endless mat obtained from the second transport belt is transferred to the oven belt, heated to 170 to 180° C. with hot air in the heating zone and then drawn through the calibration zone. Here, slight compaction is carried out to the final mat thickness of 3 to 8 mm. These mats exhibit an improved compressive rigidity, in addition to good transverse tensile strength.

Example 7

8 parts of binder fiber are well mixed with 75 parts of wood fibers and 17 parts of hemp fibers and supplied to the storage container. From the latter, the fiber mixture is blown uniformly onto a first transport belt, so that a fiber fleece with a bulk density of 150 to 220 kg/m$^3$ and in particular of 150 to 180 kg/m$^3$ is produced. Following the formation of the fiber fleece, granules are added by the powder scatterer which consists of a thermally resistant core and an encapsulation of synthetic resins which soften at the temperature prevailing in the heating zone. The quantity of granules added is so high that some granules are present in two parts of the fiber mixture. The fiber mixture is mixed well with the granules by being torn up at the end of the first transport belt and is blown onto the second transport belt. In this case, the circulation speed of the second transport belt is adjusted such that an endless mat having a thickness of 20 to 22 mm is produced. A profiled woven fleece of cellulose fibers is laid over the entire mat width on one side. The product obtained in this way is transferred on to the oven belt and heated to 170° C. At this temperature, the product is moved through the calibration rolls and compacted to the final thickness of 8 to 15 mm. The wood fiber insulating material boards obtained are primarily suitable as underlay boards in dry construction.

Example 8

For the production of wood fiber insulating material boards which, for example, can be used as above-rafter insulation and can be walked on but are not absolutely secure against passage, 11 parts of binder fibers are mixed with 89 parts of wood fibers and supplied to the storage container. From the storage container, the fiber mixture is blown onto a first transport belt in quantities such that end products have a bulk density of 70 to 150 kg/m$^3$ and in particular of 100 to 140 kg/m$^3$. Via a powder scatterer, granules are added to the preliminary fleece obtained in this way, which consist of a heat-resistant core and an encapsulation that softens in the heating zone and/or consist of synthetic resin granules which are obtained during the recycling of plastic objects from the Dual System. The quantity of granules added is 28 parts of granules to 72 parts of the fiber mixture.

The preliminary fleece with the granules scattered on is comminuted and, well mixed, is blown onto the second transport belt. In this case, the speed of the second transport belt is adjusted such that the endless mat produced has a thickness of 65 to 180 mm. In a particular configuration of this example, the mat can be provided on one side with a dense, moisture-repellant film and on the other side with a woven fleece. The mat prepared in this way and coated on both sides is led from the second transport belt onto the oven belt, heated to 175° C. in the heating zone and compacted in the calibration zone to a final thickness of 60 to 160 mm.

In the heating and calibration zone, as a result of the softening binder fibers and the granules, a good matrix is formed, in which the wood fibers are embedded and which ensure adequate attachment of the film or woven fleece applied.

Example 9

For the production of WDVS (thermal insulation composite system) load bearing boards, 12 parts of binder fibers are mixed with 88 parts of wood fibers and supplied to a storage container. Operations are carried out as described in example 8, with the difference that a bulk density of 80 to 140 kg/m$^3$ and in particular of 95 to 105 kg/m$^3$ is achieved and the granules are added in quantities of 37 parts to 63 parts of fiber mixture. Following the intimate mixing of the fiber mixture with the granules at the end of the first transport belt, the mixture is blown onto a second transport belt. In this case, the speed of the second transport belt is set such that an endless mat having a thickness of 75 to 280 mm is produced. Following the transfer to the oven belt, heating to 175° C. takes place and compaction to a final thickness of 60 to 200 mm by the calibration rolls. The boards obtained exhibit an excellent compressive rigidity and a very good transverse tensile strength.

Example 10

For the production of wood fiber insulating material boards that are secure against passage, 13 parts of binder fibers are mixed with 78 parts of wood fibers and 9 parts of flax fibers and supplied to a storage container. From the storage container, the fiber mixture is blown onto the first transport belt, specifically in quantities which result in a board having a bulk density of 170 to 270 kg/m$^3$ and in particular of 230 to 250 kg/m$^3$. Granules obtained by recycling plastic objects from the Dual System are scattered on to the fleece formed on the first transport belt, specifically in quantities of 36 parts of granules to 64 parts of fiber mixture.

For the purpose of uniform distribution of the granules in the fiber mixture, the fleece is torn up at the end of the first transport belt; the material is mixed well and then blown onto a second transport belt. In this case, the circulation speed of the second transport belt is set such that an endless mat having a thickness of 25 to 90 mm is obtained.

A structured fiber nonwoven, preferably a random fiber nonwoven, is laid onto this mat on one side, over the entire width of the endless mat.

The product obtained in this way is transferred onto the oven belt and heated to 175 to 185° C. in the heating zone. In the calibration zone, it is compacted to a thickness of 15 to 60 mm and then cooled. The three-dimensional arrangement of the fibers is also maintained after the calibration. The mats obtained exhibit a high compressive rigidity associated with an increased transverse tensile strength.

This application claims the priority, under 35 U.S.C. § 119, of German patent application No. 10 2004 062 647.2, filed Dec. 21, 2004; the entire disclosure of the prior application is herewith incorporated by reference.

I claim:

1. A wood fiber insulating material component selected from the group consisting of boards and mats, the component comprising:

a three-dimensional configuration containing wood fibers and thermoplastic binder fibers, said three-dimensional configuration having a thickness of 3 to 350 mm and a bulk density of 20 to 300 kg/m$^3$, said wood fibers and said thermoplastic binder fibers being aligned in three dimensions.

2. The wood fiber insulating material component according to claim 1, wherein said thickness has a range of 4 to 250 mm.

3. The wood fiber insulating material component according to claim 1, wherein said three-dimensional configuration further contains natural fibers in quantities up to 30%.

4. The wood fiber insulating material component according to claim 1, further comprising a further material applied to at least one or both sides of said three-dimensional configuration, said further material selected from the group consisting of structured and/or perforated woven fabrics of inorganic, organic or natural fibers, structured and/or perforated nonwoven fabrics of inorganic, organic or natural fibers, webs of cellulose and films.

5. The wood fiber insulating material component according to claim 1, wherein said thickness has a range of 60 to 250 mm and said bulk density has a range of 30 to 60 kg/m$^3$.

6. The wood fiber insulating material component according to claim 1, wherein said thickness has a range of 60 to 250 mm and said bulk density has a range of 35 to 45 kg/m$^3$.

7. The wood fiber insulating material component according to claim 1, wherein the wood fiber insulating component is a wood fiber acoustic insulating board;

wherein said thickness has a range of 60 to 250 mm;

wherein said bulk density has a range of 35 to 45 kg/m$^3$;

further comprising a perforated fiber nonwoven laid on one side of said three-dimensional configuration.

8. The wood fiber insulating material component according to claim 1, wherein:

the wood fiber insulating component is for absorbers or resonators;

said thickness has a range of 30 to 120 mm; and said bulk density has a range of 35 to 100 kg/m$^3$.

9. The wood fiber insulating material component according to claim 1, wherein:

said three-dimensional configuration further contains flax fibers;

said thickness has a range of 80 to 250 mm; and said bulk density has a range of 25 to 50 kg/m$^3$.

10. The wood fiber insulating material component according to claim 9, wherein said bulk density has a range of 25 to 40 kg/m$^3$.

11. A wood fiber insulating material component, comprising:

a three-dimensional configuration containing wood fibers, thermoplastic binder fibers, and synthetic resin granules, said three-dimensional configuration having a thickness of 3 to 350 mm, a bulk density of 20 to 300 kg/m$^3$, and a proportion of said synthetic resin granules in quantities of 5 to 45%, said wood fibers and said thermoplastic binder fibers being aligned in three dimensions.

12. The wood fiber insulating material component according to claim 11, wherein said thickness has a range of 4 to 250 mm.

13. The wood fiber insulating material component according to claim 11, wherein said proportion of said synthetic resin granules is in quantities of 10 to 40%.

14. The wood fiber insulating material component according to claim 11, wherein said proportion of said synthetic resin granules is in quantities of 22 to 37%.

15. The wood fiber insulating material component according to claim 11, wherein said three-dimensional configuration further has natural fibers in quantities up to 30%.

16. The wood fiber insulating material component according to claim 11, further comprising a further material applied to at least one or both sides of said three-dimensional configuration, said further material selected from the group consisting of structured and/or perforated woven fabrics of inorganic, organic or natural fibers, structured and/or perforated nonwoven fabrics of inorganic, organic or natural fibers, webs of cellulose and films.

17. The wood fiber insulating material component according to claim 11, wherein:

the wood fiber insulating material component is a wood fiber footfall insulating mat for laminated or parquet floors;

said thickness has a range of 3 to 8 mm;

said bulk density has a range of 150 to 280 kg/m$^3$; and said three-dimensional configuration is slightly compacted in a heating/cooling oven.

18. The wood fiber insulating material component according to claim 17, wherein said bulk density has a range of 170 to 255 kg/m$^3$.

19. The wood fiber insulating material component according to claim 11, wherein the wood fiber insulating material component is an underlay board for dry construction;

wherein said thickness has a range of 8 to 15 mm;

wherein said bulk density has a range of 130 to 220 kg/m$^3$; and further comprising a profiled woven fabric fleece applied to one side of said three-dimensional configuration, and said three-dimensional configuration being compacted in a heating/cooling oven.

20. The wood fiber insulating material component according to claim 19, wherein said bulk density has a range of 150 to 180 kg/m$^3$.

21. The wood fiber insulating material component according to claim 11, wherein:

the wood fiber insulating material component is a wood fiber above-rafter insulating board;

said thickness has a range of 60 to 160 mm;

said bulk density has a range of 70 to 150 kg/m$^3$; and said three-dimensional configuration is compacted in a heating/cooling oven.

22. The wood fiber insulating material component according to claim 21, wherein said bulk density has a range of 100 to 140 kg/m$^3$.

23. The wood fiber insulating material component according to claim 11, wherein the wood fiber insulating material component is a wood fiber above-rafter insulating board;

wherein said thickness has a range of 60 to 160 mm;

wherein said bulk density has a range of 70 to 150 kg/m$^3$;

further comprising a moisture-repellent film laid on a first side of said three-dimensional configuration;

further comprising a woven fabric fleece laid on a second side of said three-dimensional configuration; and wherein said three-dimensional configuration is compacted in a heating/cooling oven.

24. The wood fiber insulating material component according to claim 23, wherein said bulk density has a range of 100 to 140 kg/m$^3$.

25. The wood fiber insulating material component according to claim 11, wherein:

the wood fiber insulating material component is a wood fiber thermal insulation composite system load bearing board;

said thickness has a range of 60 to 200 mm;

said bulk density has a range of 80 to 150 kg/m$^3$; and said three-dimensional configuration is forcibly compacted in a heating/cooling oven.

26. The wood fiber insulating material component according to claim 25, wherein said bulk density has a range of 95 to 105 kg/m$^3$.

27. The wood fiber insulating material component according to claim 11, wherein:

the wood fiber insulating material component is a wood fiber insulating material board passage;

said thickness has a range of 15 to 60 mm;

said bulk density has a range of 170 to 270 kg/m$^3$;

said proportion of said synthetic resin granules is greater than 22%; and said three-dimensional configuration is very forcibly compacted in a heating/cooling oven.

28. The wood fiber insulating material component according to claim 27, wherein said bulk density has a range of 230 to 250 kg/m$^3$.

29. The wood fiber insulating material component according to claim 11, wherein the wood fiber insulating material component is a wood fiber insulating material board passage;

wherein said thickness has a range of 15 to 60 mm;

wherein said proportion of said synthetic resin granules is a high proportion of said synthetic resin granules;

wherein said bulk density has a range of 170 to 270 kg/m$^3$;

further comprising a structured fiber nonwoven disposed one side of said three-dimensional configuration; and wherein said three-dimensional configuration is very forcibly compacted in a heating/cooling oven.

30. The wood fiber insulating material component according to claim 29, wherein said bulk density has a range of 230 to 250 kg/m$^3$.

* * * * *